US007054566B2

(12) United States Patent
Uyama

(10) Patent No.: US 7,054,566 B2
(45) Date of Patent: May 30, 2006

(54) IMAGE FORMING APPARATUS, CARTRIDGE, AND STORAGE MEDIUM

(75) Inventor: Masao Uyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 10/808,782

(22) Filed: Mar. 24, 2004

(65) Prior Publication Data

US 2004/0202485 A1 Oct. 14, 2004

(30) Foreign Application Priority Data

Apr. 11, 2003 (JP) ..... 2003-107339

(51) Int. Cl.
*G03G 15/08* (2006.01)
*G03G 21/20* (2006.01)

(52) U.S. Cl. ..... 399/27; 399/44; 399/119

(58) Field of Classification Search ..... 399/27, 399/29, 30, 44, 94, 97, 12, 53, 58, 61, 62, 399/119

See application file for complete search history.

(56) References Cited

U.S. PATENT DOCUMENTS

| | | | | |
|---|---|---|---|---|
| 4,515,292 | A * | 5/1985 | Koos, Jr. | 399/58 |
| 5,235,384 | A * | 8/1993 | Oka et al. | 399/27 |
| 5,722,003 | A * | 2/1998 | Suzuki et al. | 399/39 |
| 5,794,094 | A * | 8/1998 | Boockholdt et al. | 399/27 |
| 5,946,522 | A * | 8/1999 | Inami | 399/27 |
| 6,353,716 | B1 * | 3/2002 | Uehara et al. | 399/44 |
| 6,389,245 | B1 * | 5/2002 | Shida et al. | 399/58 |
| 6,459,861 | B1 * | 10/2002 | Sakurai et al. | 399/27 |
| 6,532,030 | B1 * | 3/2003 | Okano et al. | 347/131 |
| 6,591,070 | B1 * | 7/2003 | Shoji et al. | 399/27 |
| 6,661,980 | B1 * | 12/2003 | Matsumoto et al. | 399/27 |
| 6,721,514 | B1 * | 4/2004 | Kida | 399/12 |
| 6,771,911 | B1 * | 8/2004 | Ko | 399/27 |
| 6,807,380 | B1 * | 10/2004 | Iida et al. | 399/12 |
| 6,859,628 | B1 * | 2/2005 | Kobashigawa | 399/44 |
| 6,871,026 | B1 * | 3/2005 | Shimura et al. | 399/12 |
| 2001/0036371 | A1 * | 11/2001 | Ozawa et al. | 399/53 |
| 2002/0025173 | A1 * | 2/2002 | Isobe et al. | 399/12 |
| 2003/0021609 | A1 * | 1/2003 | Yamaguchi et al. | 399/27 |
| 2005/0047805 | A1 * | 3/2005 | Okubo | 399/27 |

FOREIGN PATENT DOCUMENTS

| | | | |
|---|---|---|---|
| JP | 1-291274 | A | 11/1989 |
| JP | 2003228202 | A * | 8/2003 |
| JP | 2004326090 | A * | 11/2004 |

* cited by examiner

*Primary Examiner*—R. Alexander Smith
(74) *Attorney, Agent, or Firm*—Canon U.S.A. Inc I.P Division

(57) ABSTRACT

An image forming apparatus includes a developing device including a developing receptacle for accommodating a developer including a toner and a carrier, and a detector for outputting a signal corresponding to a toner density of the developer within the developer receptacle, a replenishing member for replenishing the toner to the developing receptacle in accordance with an output value from the detector, a first storage unit having a storage region storing information relating to characteristics of the developer, and a controller for controlling a replenishing operation by the replenishing member based on the output value from the detector and the information relating to characteristics of the developer.

20 Claims, 6 Drawing Sheets

IMAGE FORMING APPARATUS, CARTRIDGE, AND STORAGE MEDIUM

BACKGROUND OF THE INVENTION

1. Field of the Invention

The present invention relates to an image forming apparatus, such as a printer, a copier, a facsimile apparatus or the like, for forming a recorded image by developing an electrostatic latent image formed on an image bearing member according to an electrophotographic method, an electrostatic recording method or the like, using a developer, and then transferring the developed image onto a recording material, a cartridge detachably mountable in the image forming apparatus, and a storage medium to be mounted in the cartridge.

2. Description of the Related Art

For example, in an image forming apparatus adopting an electrophotographic method, in general, a toner image is formed by causing a toner of a charged developer to be attracted onto an electrostatic latent image formed on the surface of an image bearing member. Then, the toner image is transferred onto a recording material conveyed so as to contact the image bearing member, directly or after first transferring the toner image from the image bearing member onto an intermediate transfer member, and thereafter performing heating/fixing processing to complete image formation on the recording material.

Usually, a so-called two-component developer obtained by mixing a magnetic powder called a "carrier" and a "toner" consisting of colored particles is used as the developer. Particularly, in color image forming apparatuses, since the carrier to which the toner adheres can be conveyed to the image bearing member by magnetically holding the carrier on a developer carrying member, without adding a magnetic material in the colored particles, the two-component developer is preferably used from the viewpoint of a hue and the like. In the two-component developer, the toner is charged by friction between the toner and the carrier, and only the toner is caused to be attracted onto an electrostatic latent image formed on the surface of the image bearing member. Accordingly, if image forming processing is executed, the amount of the toner in the developer decreases. That is, the density of the toner in the developer (the ratio of the toner in the entirety of the developer, or the ratio of the amount of the toner to the amount of the carrier) changes.

Accordingly, an image forming apparatus using a two-component developer includes means for detecting the density of the toner in the developer within the main body of a developing device (developing receptacle). When the amount of the toner remaining within the developer receptacle becomes less than a predetermined (constant) value, a toner replenishing operation from a toner replenishing device is executed.

When using a two-component developer, by using automatic toner-replenishment control means ATR (automatic toner replenisher) for performing appropriate toner replenishment in accordance with a variation in the toner density by timely detecting the toner density in the developer, the toner density must always be maintained within a constant tolerance with respect to a predetermined reference value.

The automatic toner-replenishment control means usually includes toner-density detection means for detecting the toner density in the developer, toner-replenishment control means for determining the amount of toner replenishment by processing output data from the toner-density detection means, and toner replenishing means for replenishing the toner based on the amount of toner replenishment determined by the toner-replenishment control means. Particularly, various types of toner-density detection means have been put into practical use.

For example, there are types of toner-density detection means that: utilize the fact that the optical reflectivity of the developer within the developing receptacle or the developer bearing member changes depending on the toner density; utilize a permeability sensor for converting permeability into an electric signal by utilizing the fact that the permeability of the developer changed depending of the toner density; indirectly estimate the toner density in the developer by detecting a change in the optical reflectivity of a predetermined patch image formed on a latent-image bearing member in predetermined conditions; and the like.

In image forming apparatuses of a type that form a digital latent image using a laser scanner or an LED (light-emitting diode) array, since the amount of toner consumption per page can be relatively correctly estimated from the accumulated value (the number of video counts) of the number of printed pixels in an image information signal per page, automatic toner-replenishment control means of a type of determining the amount of toner replenishment in accordance with the estimated amount of toner consumption (hereinafter termed a "video count ATR") are known.

Although the video ATR is advantageous from the viewpoint of the cost because toner-density detection means is unnecessary, it has the disadvantage that errors in the amount of toner replenishment are gradually accumulated. Accordingly, some way for correcting the errors is necessary, and it is currently difficult to use the video count ATR by itself.

As described above, it is necessary to provide detection means in the developing device. At the same time, it is desirable to reduce the size of the developing device. Accordingly, automatic toner-replenishment control means using a permeability sensor as toner-density detection means is often selected because only a space for installing the permeability sensor is required, resulting in reduction of the size of the apparatus.

The permeability sensor is disposed, for example, at part of a developer conveying channel, or the like within the developing device so that a head portion of the sensor incorporating a coil, serving as a detection unit, always contacts the developer. The intensity of a magnetic field generated when a high-frequency voltage is applied to the coil within the head changes depending on the permeability around the head. Accordingly, by measuring self-inductance of the coil itself (or mutual inductance of a separate coil for measurement), the permeability of the developers around the head can be converted into an electric output value (voltage value).

The permeability sensor is usually disposed so as to face a developer conveying member for conveying a developer by rotating. Hence, the voltage output value of the permeability sensor that detects the permeability of the developer varies in accordance with the rotation of the developer conveying member. Accordingly, when representing the detection value (detection signal) of the permeability sensor that has detected the permeability of the developer, a mean value of voltage detection values of the permeability sensor at one rotation of the developer conveying member is generally used.

Conventional automatic toner-replenishment control means using such a permeability sensor as toner-density detection means have the problem that the detection signal of the permeability sensor corresponding to apparent permeability changes due to a change in the bulk density of the developer may actually be caused by a variation in environment. That is, in a low-temperature and low-humidity environment, the amount of water contained in the developer decreases, resulting in an increase in charges of the toner caused by contact between the toner and the carrier. As a result, repulsion between the toner and the carrier in the developer increases, thereby reducing the bulk density of the developer. Inversely, in a high-temperature and high-humidity environment, the amount of water contained in the developer increases, resulting in a decrease in charges of the toner caused by contact between the toner and the carrier. As a result, repulsion between the toner and the carrier in the developer decreases, thereby increasing the bulk density of the developer. That is, although the toner density in the developer receptacle is constant, the output value of the permeability sensor varies depending on the environment.

In general, as the amount of use (hereinafter represented by a "number of printed copies") of the developing device increases, charges (triboelectrification) of the toner in the developer tend to decrease due to degradation of the developer including the toner and the carrier. The carrier is degraded due to changes in the surface property caused by mechanical stress produced, for example, by being stirred, adherence of an additive, and the like. The toner is degraded due to addition or separation of an additive, and the like. As a result, charges (triboelectrification) of the toner decrease. In this case, the bulk density of the developer also changes, and the output value of the permeability sensor changes depending on the number of printed copies although the toner density of the developer is constant.

Conventionally, correction is performed so as to stabilize the toner density of the developer by changing a control voltage input to the permeability sensor, or changing a reference output value for the permeability sensor to be compared with the current detection value of the permeability sensor in order to obtain the amount of toner replenishment, in accordance with information relating to environment and the number of printed copies. It is therefore possible to detect the toner density without causing any problem even if the bulk density of the developer changes depending on environment and the number of printed copies (for example, refer to Japanese Patent Application Laid-Open (Kokai) No. 1-291274 (1989)).

However, even if correction is performed for the operation of automatic toner-replenishment control means using a permeability sensor as toner-density detection means, in accordance with information relating to the environment and the number of printed copies in the above-described manner, the characteristics of the developer sometimes greatly change due to variations in production conditions, differences in the type of the developer, and the like, sometimes resulting in instability of the toner density of the developer. That is, when triboelectrification of the toner in the developer is high, the output value of the permeability sensor is larger than the value for the actual toner density because the amount of the carrier per unit volume decreases. Accordingly, if the density is controlled by replenishing the toner based on the output value, the toner is not sufficiently supplied as the number of printed copies increases, resulting in a small toner density in the developer. When the toner density in the developer decreases, the image density sometimes decreases. To the contrary, when triboelectrification of the toner in the developer is low, the output value of the permeability sensor is smaller than the value for the actual toner density because the amount of the carrier per unit volume increases. Accordingly, if the density is controlled by replenishing the toner based on the output value, too much amount of the toner is supplied as the number of printed copies increases, resulting in a large toner density in the developer. When the toner density in the developer thus increases, the problems of fog, and dispersion of toner particles sometimes occur.

Accordingly, there is a need for an image forming apparatus that can properly control the toner density in a developer.

SUMMARY OF THE INVENTION

According to an aspect of the present invention, an image forming apparatus including, a cartridge and a storage medium that can properly control the toner density in a developer are provided in accordance with the characteristics of the developer.

In accordance with another aspect of the present invention, an image forming apparatus is provided that can stably control the toner density of a developer easily with a low cost, and prevent the problems of fog, toner dispersion, a decrease in the image density, and the like, even if the characteristics of the developer largely change.

According to one aspect of the present invention, an image forming apparatus includes a developing device including a developing receptacle for accommodating a developer including a toner and a carrier, and a detector for outputting a signal corresponding to a toner density of the developer within the developing receptacle, a replenishing member for replenishing the toner to the developing receptacle, a controller for controlling an operation of replenishing the toner to the developing receptacle by the replenishing member, in accordance with an output value from the detector and information relating to characteristics of the developer, and a first storage unit for storing information relating to the characteristics of the developer.

In accordance with another aspect of the present invention, the controller may control the replenishing operation based on the output value from the detector and a predetermined reference value and correct the reference value using information based on the information relating to characteristics of the developer.

In accordance with another aspect of the present invention, the image forming apparatus may include a second storage unit for storing a plurality of correction information for correcting the reference value. The controller corrects the reference value based on the information relating to the characteristics of the developer stored in the first storage unit, and the correction information stored in the second storage unit.

In accordance with yet another aspect of the present invention, the correction information may be a correction table for correlating an environment or an amount of use of the developing device with an amount of correction for the reference value.

In accordance with still another aspect of the present invention, the image forming apparatus may include an environment detection sensor for detecting an environment within the image forming apparatus. The controller corrects the reference value using information relating to the environment from the environment detection sensor, information relating to an amount of use of the developing device, and the information relating to characteristics of the developer.

In accordance with yet another aspect of the present invention, the first storage unit may include a storage region for storing the information relating to the amount of use of the developing device.

In accordance with a further aspect of the invention, the developing device may be detachably mountable in a main body of the image forming apparatus, with the first storage unit being provided in the developing device.

In accordance with a yet a further aspect of the present invention, a cartridge including at least the developing device and an image bearing member may be detachably mountable in the image forming apparatus, with the first storage unit being provided in the cartridge.

In accordance with another aspect of the present invention, the first storage unit may include a storage region storing an offset value for the reference value and the controller controls the replenishing operation based on the offset value and the information relating to characteristics of the developer.

In accordance with yet another aspect of the present invention, the detector may be a permeability sensor for outputting a signal corresponding to the permeability of the developer.

According to another aspect of the present invention, a developing device detachably mountable in an image forming apparatus includes a developing receptacle for accommodating a developer including a toner and a carrier, a detector for outputting a signal corresponding to a toner density of the developer within the developing receptacle, and a storage medium for storing information relating to the developing device. The storage medium includes a first storage region for storing information relating to characteristics of the developer for correcting a reference value of the detector used for supplying the developing receptacle with the toner.

In accordance with another aspect of the invention, the storage medium includes a communication portion for communicating with the image forming apparatus.

According to still another aspect of the present invention, a storage medium to be mounted in a developing device detachably mountable in an image forming apparatus, the developing device including a developing receptacle for accommodating a developer including a toner and a carrier, and a detector for outputting a signal corresponding to a toner density of the developer within the developing receptacle. The storage medium includes a first storage region for storing information relating to characteristics of the developer for correcting a reference value of the detector used for supplying the developing receptacle with the toner.

The foregoing and other aspects, advantages and features of the present invention will become more apparent from the following detailed description of the preferred embodiments taken in conjunction with the accompanying drawings.

DESCRIPTION OF THE PREFFRRED EMBODIMENTS

An image forming apparatus according to an embodiment of the present invention will now be described in detail with reference to the drawings.

Figure 1:
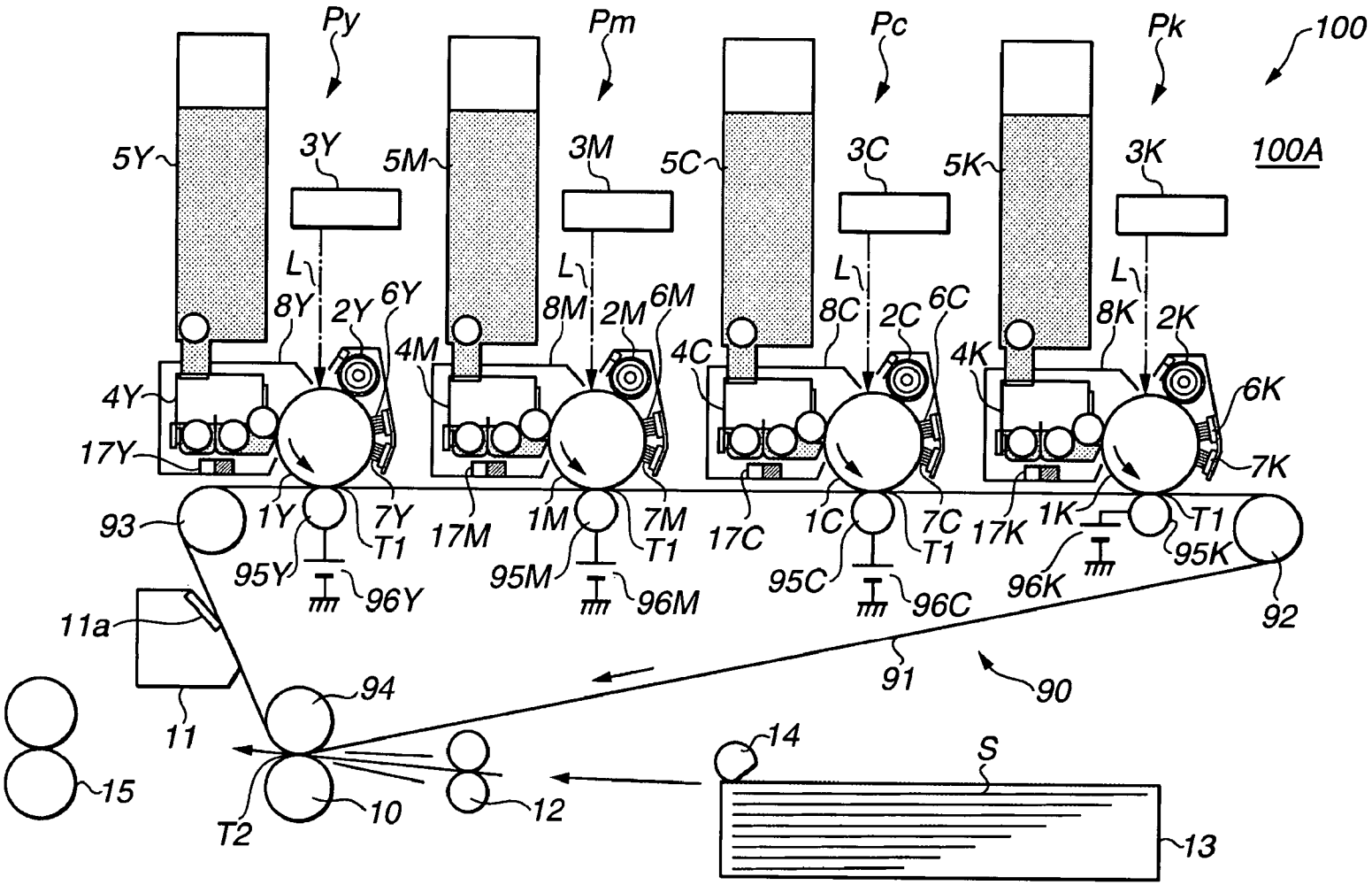
FIG. 1 is a schematic cross-sectional view illustrating an image forming apparatus according to an embodiment of the present invention.

FIG. 1 is a schematic cross-sectional view illustrating an image forming apparatus 100 according to the embodiment. In this embodiment, the present invention is realized in a color laser printer (hereinafter simply termed an "image forming apparatus") 100 having an A3 size as the maximum sheet size that can form a full-color image on a recording material, such as a recording sheet S, an OHP (overhead projector) sheet, a cloth, or the like, utilizing a transfer-type electrophotographic process in which a contact charging method and a reversal development method are adopted.

Configuration of the Image Forming Apparatus

First, the entire configuration of the image forming apparatus 100 will be described. The image forming apparatus 100 includes first through fourth image forming units Py, Pm, Pc and Pk, serving as a plurality of image forming means for forming toner images of different colors (yellow (Y), magenta (M), cyan (C) and black (K) in this embodiment). The image forming apparatus 100 is a so-called four-consecutive-drum-type (in-line type) printer in which a full color printed image is obtained by consecutively transferring toner images formed by the image forming units Py–Pk onto an intermediate transfer belt 91, serving an intermediate transfer member, and then transferring the toner images onto a recording material S. The image forming apparatus 100 adopts a process cartridge method in which process cartridges 8Y, 8M, 8C and 8K, each obtained by integrally forming an electrophotographic photosensitive member, serving as an image bearing member, and process means operating thereon, are detachably mountable in an image-forming-apparatus main body 100A at the image forming units Py–Pk, respectively. The four process cartridges 8Y–8K are disposed in the order of yellow (Y), magenta (M), cyan (C) and black (K) in series along the moving direction of the intermediate transfer belt 91.

The image forming units Py–Pk basically have the same configuration except that images of corresponding colors are formed using developers of corresponding different colors. Accordingly, unless discrimination is particularly required, general description will be provided by omitting suffixes Y, M, C and K provided for indicating components corresponding to the image forming units Py–Pk, respectively.

Figure 2:
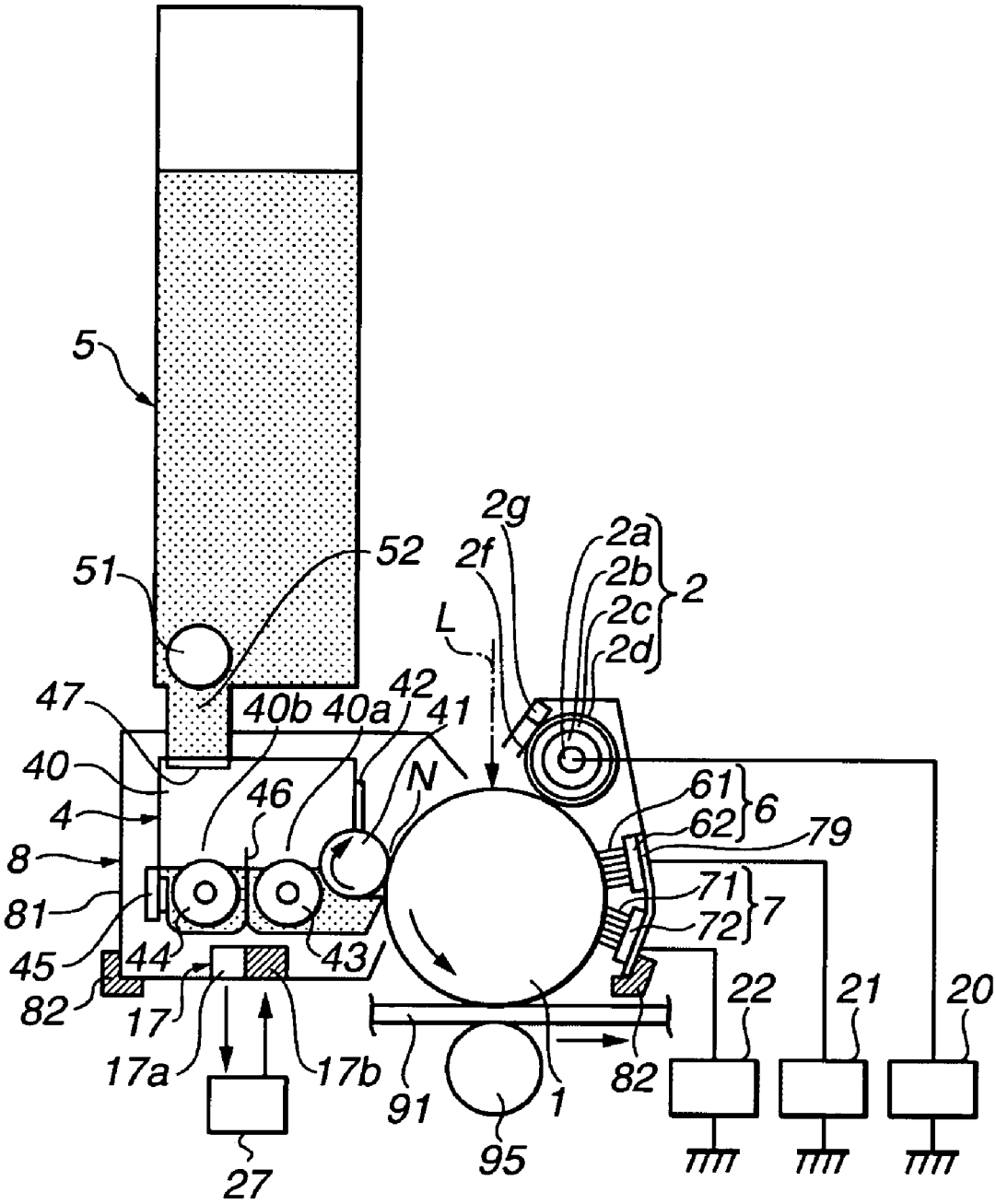
FIG. 2 is a schematic cross-sectional view illustrating the details of an image forming unit of the image forming apparatus shown in FIG. 1.

The image forming unit will now be described with reference to FIG. 2 illustrating the image forming unit in more detail. A rotating-drum-type electrophotographic photosensitive member (photosensitive drum) 1, serving as an image bearing member, is provided at the image forming unit. In this embodiment, the photosensitive drum 1 is made of an organic photoconductor (OPC) and has an outer diameter of 30 mm. The photosensitive drum 1 is rotatably driven in the direction of an arrow shown in FIG. 2 around a central axis at a process speed (circumferential speed) of 100 mm/sec. In this embodiment, the photosensitive drum 1 has a longitudinal length of 370 mm, and is obtained by sequentially coating three layers, i.e., an undercoat layer for suppressing interference of light and improving the adhering property of an upper layer, a photoelectric-charge generation layer, and a charge transfer layer (20 μm thick) on an aluminum cylinder (a conductive-drum base member). In this embodiment, the width of coating allowing contact charging processing for the photosensitive drum 1 is set to 340 mm.

The photosensitive drum 1 may have a direct injection charging property having a charge injection layer having a surface resistance of $10^9$–$10^{14}$ Ω·cm. The same effects may also be obtained even when a charge injection layer is not used, for example, when the resistance of the charge transport layer is within the above-described range of resistance. An amorphous-silicon photosensitive member whose surface layer has a volume resistance of $10^{13}$ Ω·cm may also be used.

A charging roller 2, serving as a contact charger, is provided in the image forming unit as charging means. In a charging process, a voltage in a predetermined condition is applied from charging-bias-voltage applying means to the charging roller 2, to uniformly charge the surface of the photosensitive drum 1 at a negative polarity. The charging roller 2 has a three-layer structure obtained by sequentially laminating a lower layer 2*b*, an intermediate layer 2*c* and a surface layer 2*d* on the circumference of a core (supporting member) 2*a*. The lower layer 2*b* is a porous-sponge layer for reducing a charging sound. The intermediate layer 2*c* is a resistive layer for causing the entire charging roller 2 to have a uniform resistance value. The surface layer 2*d* is a protective layer provided for preventing the generation of leakage even if a defect, such as a pinhole or the like, is present in the surface of the photosensitive drum 1. In the charging roller 2 of this embodiment, a stainless-steel bar having a diameter of 6 mm is used as the core 2*a*, the surface layer 2*d* is obtained by dispersing carbon in a fluororesin. In this embodiment, the outer diameter, the roller resistance, and the longitudinal length (charging width) of the charging roller 2 are 14 mm, $10^4$–$10^7$ Ω, and 320 mm, respectively.

Both end portions of the core 2*a* of the charging roller 2 are rotatably supported by bearing members, and are urged toward the photosensitive drum 1 by respective pressing springs, so that the charging roller 2 is in pressure contact with the surface of the photosensitive drum 1 with a predetermined pressing force, and is rotatably driven in accordance with rotation of the photosensitive drum 1. By applying a predetermined oscillating voltage (a bias voltage Vdc+Vac) obtained by superposing an AC voltage having a predetermined frequency on a DC voltage from a charging-bias-voltage power supply 20, serving as charging-bias-voltage applying means, to the charging roller 2 via the core 2*a*, the circumference of the rotating photosensitive drum 1 is charged to a predetermined potential.

In this embodiment, the oscillating voltage is obtained by superposing a sinusoidal AC voltage having a frequency f of 1,150 Hz, and a peak-to-peak voltage Vpp of 1,400 V on a DC voltage of −500 V, and the circumference of the photosensitive drum 1 is uniformly subjected to contact charging processing to −500 V (a dark potential of Vd).

A charging-roller cleaning member 2*f* is provided as a cleaning member for the charging roller 2. In this embodiment, the charging-roller cleaning member 2*f* is a flexible cleaning film having a longitudinal length of 330 mm. The cleaning film 2*f* is disposed parallel to the longitudinal direction of the charging roller 2. One end of the cleaning film 2*f* is fixed to a supporting member 2*g* performing reciprocating movement of a constant amount in the longitudinal direction of the charging roller 2. The cleaning film 2*f* forms a contact nip with the charging roller 2 at a surface near a free-end side of the cleaning film 2*f*. In this embodiment, reciprocating movement of 6 mm is performed. The supporting member 2*g* is subjected to reciprocating driving of a constant amount in the longitudinal direction by a driving motor, serving as driving means, provided in an image-forming-apparatus main body 100A via a gear train, and the surface layer 2*d* of the charging roller 2 is brought in sliding contact with the cleaning film 2*f*. Thus, contaminant (toner particles, an additive, and the like) adhering to the surface layer 2*d* of the charging roller 2 is removed.

Alternatively, instead of the charging roller, any other member having an appropriate shape and made of an appropriate material, such as a fur brush, a felt, a cloth, or the like, may also be used as the flexible contact charging member. A member having appropriate elasticity, conductivity, surface property and durability may also be obtained by combining various materials. The waveform of the AC voltage (a voltage whose value periodically changes) component of the oscillating voltage applied to the contact charging member and the developing member may be appropriately selected, such as sinusoidal, rectangular, triangular, or the like. A rectangular waveform obtained by periodically turning on/off a DC power supply may also be used.

By performing image exposure L by image exposure means 3 after performing uniform charging processing to predetermined polarity and potential by the charging roller 2, an electrostatic latent image of a color component for a corresponding one of the image forming units Py–Pk of a target color image is formed on the surface of the photosensitive drum 1. Examples of image exposure means 3 include a color separation/imaging/exposing optical system for an image of a color original, a scanning exposure system by laser scanning to output a laser beam modulated in accordance with a time-serial electrical digital pixel signal of image information, or the like.

In this embodiment, a laser beam scanner using a semiconductor laser is used as the exposure apparatus 3. By outputting a laser beam modulated in accordance with an image signal transmitted from an image reading device, or a host apparatus, such as a personal computer or the like, communicably connected to the image-forming-apparatus main body 100A, the uniformly charged surface of the rotating photosensitive drum 1 is subjected to laser scanning exposure (image exposure). An electrostatic latent image corresponding to image information subjected to scanning exposure is formed on the surface of the rotating photosensitive drum 1, as a result of a decrease of the potential on a portion irradiated by the laser beam on the surface of the photosensitive drum 1. In this embodiment, the potential of an exposed portion is set to −150 V.

The image exposure means, serving as information writing means for the charged surface of the photosensitive member 1, serving as the image bearing member, may comprise, for example, digital exposure means using a solid-state light-emitting-device array, such as an LED (light-emitting diode) array, instead of the laser scanning means of the embodiment. Alternatively, analog image exposure means may also be used, for example, using a halogen lamp, a fluorescent lamp, or the like as an original-illuminating light source. In short, any means that can form an electrostatic latent image corresponding to image information may be used.

The electrostatic latent image formed on the photosensitive drum 1 is developed using a toner by a developing device 4, serving as developing means. The developing device 4 will be described later in more detail.

The toner image formed on the photosensitive drum 1 enters a primary transfer nip portion T1 that is a contact portion between an intermediate transfer belt 91 of an intermediate transfer unit 90 and the photosensitive drum 1.

In this embodiment, at the primary transfer nip portion T1, a primary transfer roller 95, serving as primary transfer means, is raised by springs having a force of 500 gf, provided at both ends of the primary transfer roller 95, and contacts the back of the intermediate transfer belt 91 with a force obtained by subtracting the weight of the transfer roller 95 of 150 g from the force of the spring.

In this embodiment, the primary transfer roller 95 is made of a conductive sponge, and has a resistance value equal to or less than $10^6$ Ω, an outer diameter of 16 mm, and a longitudinal length of 330 mm. Primary transfer bias-voltage power supplies 96Y, 96M, 96C and 96K, serving as primary transfer bias-voltage applying means, are connected to the primary roller 95 so as to be able to independently apply a primary transfer bias voltage to the image forming units Py–Pk, respectively. According to a predetermined primary transfer bias voltage applied to the primary transfer roller 95, the toner image on the rotating photosensitive drum 1 is transferred onto the intermediate transfer belt 91 moving at a speed substantially equal to the circumferential speed of the photosensitive drum 1.

For example, when forming a full-color image of four colors, first, at the first image forming unit Py, a yellow toner image, i.e., an image of a first color, is transferred onto the intermediate transfer belt 91. Then, toner images of magenta, cyan and black colors formed at the second through fourth image forming units Pm-Pk, respectively, according to the same process are sequentially subjected to multiplex transfer (primary transfer) onto the intermediate transfer belt 91 from the photosensitive drum 1.

In this embodiment, in consideration of the transfer efficiency for the toner image developed at tan exposed portion V1 (having a potential of −150 V), a current having a value of about +8 μA is applied as a primary transfer bias current for all of the first through fourth colors. The current value may be corrected depending on environment, or the current value may be set to a larger value only for a first color that is not influenced by retransfer.

In this embodiment, the endless intermediate transfer belt 91 is stretched around a driving roller 92, a tension roller 93 and a secondary transfer facing roller 94, and is driven by a driving motor (not shown), serving as driving means, included in the image-forming-apparatus main body 100A, to rotatably move (rotate) in the direction of an arrow shown in FIG. 1.

As for the material for the intermediate transfer belt 91, in order to provide excellent registration at each of the image forming units Py–Pk, an expandable material is not desirable. A resin belt, a rubber belt containing a metal core, or a belt made of resin and rubber is desirable. In this embodiment, a resin belt made by dispersing carbon in polyimide, whose volume resistance is controlled to the order of $10^8$ Ω·cm is used. The belt has a thickness of 80 μm, a longitudinal length of 390 mm, and a circumference of 900 mm.

For example, when forming a full-color image of four colors, a full-color image of four colors formed on the intermediate transfer belt 91 in the above-described manner is transferred (subjected to primary transfer) onto a recording material S at a time by applying a predetermined secondary transfer bias voltage to a secondary transfer roller 10, serving as secondary transfer means, from a secondary-transfer-bias-voltage power supply (not shown), serving as secondary-transfer-bias-voltage applying means, at a secondary transfer nip portion T2 that is a contact portion between the secondary transfer roller 10 and the intermediate transfer belt 91.

The recording material S is conveyed from a cassette 13, serving as a recording-material accommodating unit, to the secondary transfer nip portion T2 by recording-material conveying means comprising a recording-material supply roller 14, a registration roller 12, and the like in synchronization with the timing that the toner image on the intermediate transfer belt 91 reaches the secondary transfer nip portion T2.

After the toner image has been transferred, the recording material S is separated from the intermediate transfer belt 91 and conveyed to a fixing device 15, where the unfixed toner image is fused and fixed on the recording material S by heat and pressure, and a color printed image is discharged outside of the image-forming-apparatus main body 10A. Toner particles remaining on the intermediate transfer belt 91 after the secondary transfer process are cleaned by a cleaning blade 11*a* of an intermediate-transfer-belt cleaner 11, in order to prepare for the next image forming process. In this embodiment, the longitudinal length of the cleaning blade 11*a* is set to 330 mm.

Toner particles remaining on the photosensitive drum 1 after the primary transfer process are removed from the photosensitive drum 1 by developer-charging-amount control means 6 and remaining-developer homogenizing means 7. The developer-charging-amount control means 6 and the remaining-developer homogenizing means 7 contact the photosensitive drum 1.

That is, toner particles remain on the surface of the photosensitive drum 1 after the transfer process. The remaining toner particles include negative-polarity toner particles at an image portion, positive-polarity toner particles at a non-image portion, and toner particles whose polarity is inverted into a positive polarity by being influenced by a positive voltage at the transfer process. In order to arrange the polarity of these remaining toner particles to a positive polarity, the developer-charging-amount control means 6 is provided. A negative DC voltage that has the same polarity as the ordinary charging polarity of toner particles is applied from a first developer-charging power supply 21 to the developer-charging-amount control means 6. In order to disperse partial or a large amount of toner particles remaining after the transfer, the remaining-developer homogenizing means 7 is provided. A positive DC voltage that has a polarity inverse to the ordinary charging polarity of toner particles is applied from a second developer-charging power supply 22 to the remaining-developer homogenizing means 7. An AC voltage may be applied to the remaining-developer homogenizing means 7.

By thus being homogenized on the photosensitive drum 1 by the remaining-developer homogenizing means 7 and sufficiently charged to a negative polarity by the developer-charging-amount control means 6, remaining toner particles are recovered in the developing unit 4 by an electric field formed between a developing sleeve 41, serving as a developer carrying member, and the photosensitive drum 1 at a portion N facing the developing device 4, after passing through the charging roller 2 to which a negative charging bias voltage is applied.

In this embodiment, each of the developer-charging-amount control means 6 and the remaining-developer homogenizing means 7 uses a brush member made of conductive fibers. More specifically, the developer-charging-amount control means 6 includes a brush unit 61 on a laterally long electrode plate 62, and the remaining-developer homogenizing means 7 includes a brush unit 71 on a laterally long electrode plate 72. The brush units 61 and 71 are disposed so as to contact the surface of the photosensitive drum 1. Each of the brush units 61 and 71 controls the resistance value by causing carbon and metal powder to be contained in fibers made of rayon, acrylic resin, polyester resin or the like. The diameter and the density of the fibers of the brush units 61 and 71 are preferably equal to or less than 30 denier, and at least 10,000–500,000 per square inch. In this embodiment, the fibers of each of the brush units 61 and 71 have a diameter of 6 denier, a density of 100,000 per square inch, a length of 5 mm, and a volume resistivity of $6\times10^{3}$ Ω·cm.

The developer-charging-amount control means 6 and the remaining-developer homogenizing means 7 are fixed on a supporting member 79 disposed substantially parallel to the longitudinal direction of the photosensitive drum 1 and performing a reciprocating operation of a constant amount with respect to the longitudinal direction of the photosensitive drum 1. In this embodiment, the brush units 61 and 71 are disposed so as to contact the surface of the photosensitive drum 1 with an amount of penetration of 1 mm, and a contact-nip-portion width of 5 mm. The supporting member 79 is subjected to reciprocating driving of a constant amount with respect to the longitudinal direction of the photosensitive drum 1 by a driving motor (not shown), serving as driving means, provided in the image-forming-apparatus main body 10A, so that the surface of the photosensitive drum 1 is brushed by the brush unit 61 of the developer-charging-amount control means 6, and the brush unit 71 of the remaining-developer homogenizing means 7. In this embodiment, the amount of the reciprocating driving is set to 5 mm.

Although in this embodiment, each of the developer-charging-amount control means 6 and the remaining-developer homogenizing means 7 comprises a fixed brush-shaped member, any other appropriate member, such as a sheet-shaped member, or the like, may also be used.

Developing Device

Next, the developing device 4 included in the image forming apparatus 100 of the embodiment will be described in more detail.

The developing device 4 of the embodiment is a two-component contact developing device (two-component magnetic-brush developing device) that uses a two-component developer mainly including magnetic particles (a carrier) and resin colored particles (a toner) as a developer, and develops an electrostatic latent image formed on the photosensitive drum 1 by causing the two-component developer to contact the photosensitive drum 1.

The developing device 4 accommodates a two-component developer that is a mixture of a toner and a magnetic carrier, within a developing receptacle (developing-device main body) 40. Part of the developing receptacle 40 facing the photosensitive drum 1 is open, and a nonmagnetic developing sleeve 41, serving as a developer carrying member, incorporating a fixed magnet roller, serving as magnetic-field generation means, is provided at a position facing the opening. The developing sleeve 41 is disposed within the developing device 40 so as to be rotatable in the direction of an arrow shown in FIG. 2, in a state in which part of the circumference of the developing sleeve 41 is exposed outside of the developing receptacle 40. In this embodiment, the developing sleeve 41 has an outer diameter of 16 mm, and a developing width of 310 mm. A developer regulating blade 42, serving as a developer regulating member, is provided above the developing sleeve 41 in FIG. 2, and first screw 43 and second screw 44 are disposed as developer stirring members, at a base side within the developing receptacle 40.

In this embodiment, the developer regulating blade 42 is provided so as to have a gap of 250 μm with the developing sleeve 41, and forms a thin layer of the developer on the developing sleeve 41 in accordance with rotation of the developing sleeve 41 in the direction of an arrow shown in FIG. 2. The developing sleeve 41 is disposed so as to face the photosensitive drum 1 at a shortest distance (termed an "S-D gap") of 400 μm with the photosensitive drum 1. A facing portion between the photosensitive drum 1 and the developing sleeve 41 is a developing portion N.

In this embodiment, the developing sleeve 41 is rotatably driven with respect to the photosensitive drum 1 at a speed of a circumferential speed ratio of 170% in a direction reverse to the moving direction of the photosensitive drum 1. The thin layer of the developer on the developing sleeve 41 contacts and appropriately rubs the surface of the photosensitive drum 1 at the developing portion N. A predetermined developing bias voltage is applied from a developing-bias-voltage power supply (not shown), serving as developing-bias-voltage applying means, to the developing sleeve 41. In this embodiment, the developing bias voltage for the developing sleeve 41 is an oscillating voltage obtained by superposing an AC voltage (Vac) on a DC voltage (Vdc). More specifically, the developing bias voltage is obtained by superposing an AC voltage Vac of 1,800 V having a frequency of 2,300 Hz on a DC voltage Vdc of −350 V.

The developer is coated on the surface of the rotating developing sleeve 41 as a thin film, and the toner in the developer conveyed to the developing portion N selectively adheres onto the photosensitive drum 1 in accordance with the electrostatic latent image by an electric field formed between the developing sleeve 41 and the photosensitive drum 1, by the developing bias voltage applied to the developing sleeve 41. Thus, the electrostatic latent image on the photosensitive drum 1 is developed as a toner image. In this embodiment, toner particles charged to the same polarity as the charging polarity (negative in this embodiment) of the photosensitive drum 1 adhere to exposed light portions on the photosensitive drum 1, so that the electrostatic latent image is subjected to reversal development.

The thin layer of the developer on the developing sleeve 41 passing through the developing portion N is returned to a developer collecting portion within the developing receptacle 40 in accordance with subsequent rotation of the developing sleeve 41.

The first and second screws 43 and 44 provided within the developing receptacle 40 have the function of providing the toner with predetermined charges (triboelectrification) by friction between the toner and the carrier, by conveying the developer while mixing and stirring the toner replenished into the developing receptacle 40 and the developer within the developing receptacle 40 in a manner as will be described later in detail, by rotating in synchronization with the rotation of the developing sleeve 41.

More specifically, the inside of the developing receptacle 40 is sectioned in the longitudinal direction by a partition 46, and the first screw 43 and the second screw 44 are disposed in a developing chamber 40*a* provided at a side facing the developing sleeve 41 and in a stirring chamber 40*b* provided at another side, respectively, so as to be substantially parallel to the longitudinal direction of the developing sleeve 41. Each of the screws 43 and 44 has a fin on the corresponding rotation shaft, and the screws 43 and 44 convey the developer in opposite directions along the longitudinal direction. The developer can move between the stirring chamber 40*b* and the developing chamber 40*a* via openings provided at both end portions of the partition 46 in the longitudinal direction. Thus, the toner replenished into the stirring chamber 40*b* in a manner as will be described later is conveyed to the developing chamber 40*a* while being mixed and stirred with the developer within the stirring chamber 40*b* by the second screw 44, and is supplied to the developing sleeve 41 in order to be used for development. The developer after being subjected to developing is returned to the developing chamber 40*a*, is then conveyed to the stirring chamber 40*b* by the first screw 43, and is again mixed and stirred with a replenished toner. Thus, the developer circulates within the developing receptacle 40. In this embodiment, in order to improve the developer stirring effect, and the property of supplying the developer to the developer sleeve 41, a rib protruding in a direction substantially perpendicular to the direction of the axis of each of the screws 43 and 44 is provided between respective fins of the first screw 43 and the second screw 44.

The average particle diameter of the toner is preferably 5–10 μm, and more preferably, 6–9 μm. In this embodiment, a negatively chargeable toner having an average particle diameter of 7 μm is used. A magnetic carrier having saturation magnetization of 205 emu/cm$^3$ and an average particle diameter of 35 μm is used as the carrier. At first, a mixture of the toner and the carrier with a weight ratio of 6:94 is accommodated within the developing receptacle 40 as the developer. In this embodiment, the amount of charging of the toner developed on the photosensitive drum 1 is −25 μC/g.

Process Cartridge

In this embodiment, the photosensitive drum 1, the developing device 4 and the charging roller 2 are integrated in a frame 81 as a unit, to provide a process cartridge 8 detachably mountable in the image-forming-apparatus main body 100A. In this embodiment, the developer-charging-amount control means 6, the remaining-developer homogenizing means 7, the charging-roller cleaning film 2*f* and the like are also integrated in the process cartridge 8.

The process cartridge 8 is detachably mounted in the image-forming-apparatus main body 100A via mounting means 82 provided in the image-forming-apparatus main body 100A. When the process cartridge 8 is appropriately mounted in the image-forming-apparatus main body 100A, a driving motor, serving as driving means, provided in the image-forming-apparatus main body 100A, and driving transmission means for transmitting driving to the photosensitive drum 1 are connected to each other, so that the photosensitive drum 1, the developing device 4 (the developing sleeve 41, the first screw 43 and the second screw 44) the supporting member 2*g* for the charging-roller cleaning film 2*f*, and the like can be driven, and a developer replenishing receptacle 5 provided in the image-forming-apparatus main body 100A, and the developing device 4 are connected to each other.

Furthermore, when the process cartridge 8 is appropriately mounted in the image-forming-apparatus main body 100A, a state is provided in which a voltage can be applied from respective voltage application means provided in the image-forming-apparatus main body 100A to the charging roller 2, the developing sleeve 41, the developer-charging-amount control means 6, and the remaining-developer homogenizing means 7 via corresponding electric contacts provided at the image-forming-apparatus main body 100A.

In addition, as will be described later, when the process cartridge 8 is appropriately mounted in the image-forming-apparatus main body 100A, developing-device-side storage means 17*a* provided in the developing device 4 and a control unit 30 of the image-forming-apparatus main body 100A can communicate with each other via developing-device-side transmission means (communication means) 17*b* and apparatus-main-body-side transmission means (communication means) 27, and a permeability sensor 45 provided in the developing device 4 and the control unit 30 of the image-forming-apparatus main body 100A can communicate with each other via corresponding electric contacts provided at the process cartridge 8 and the image-forming-apparatus main body 100A.

The process cartridge 8 is not limited to the above-described embodiment. The present invention may be applied to any other process cartridge, provided that an electrophotographic photosensitive member, serving as an image bearing member, and process means operating on the electrophotographic photosensitive member including at least developing means are integrated as a cartridge so as to be detachably mountable in the image-forming-apparatus main body 100A. Such process means include charging means for charging the electrophotographic photosensitive member, cleaning means for cleaning the electrophographic photosensitive member, and the like.

Toner Replenishment

The image forming apparatus 100 includes automatic-toner-replenishment control means (ATR) in order to timely replenish substantially the amount of the toner consumed in a developing operation from the developer replenishing receptacle 5 connected to the developing device 4 to the developing receptacle 40.

The automatic-toner-replenishment control means includes toner-density detection means for detecting the toner density in the developer, toner-replenishment control means for determining the amount of toner replenishment by processing output data from the toner-density detection means, and toner replenishing means for replenishing the toner based on the amount of toner replenishment determined by the toner-replenishment control means.

The image forming apparatus 100 of the embodiment provides the permeability sensor 45 for detecting the toner density in the developer by detecting a change in the permeability of the developer on a wall at an upstream portion in the developer conveying direction of the second screw 44 within the developing receptacle 40. In this embodiment, the distance between the measuring surface (the head portion) of the permeability sensor 45 and the outer circumference of the fin of the second screw 44 is set to 0.5 mm. The configuration of the permeability sensor 45 is the same as a conventional one.

The second screw 44 conveys the developer by rotating. Accordingly, in accordance with the rotation of the second screw 44, the bulk density of the developer near the measuring surface of the permeability sensor 45 changes. As a result, an output voltage value from the permeability sensor 45 changes in accordance with the rotation of the second screw 44. In general, the mean value of output voltage values of the permeability sensor 45 is used as the detection value (detection signal) of the permeability sensor 45. In this embodiment, the detection value of the permeability sensor 45 is represented by the mean value of output voltage values of the permeability sensor 45 during one rotation of the second screw 44.

Figure 3:
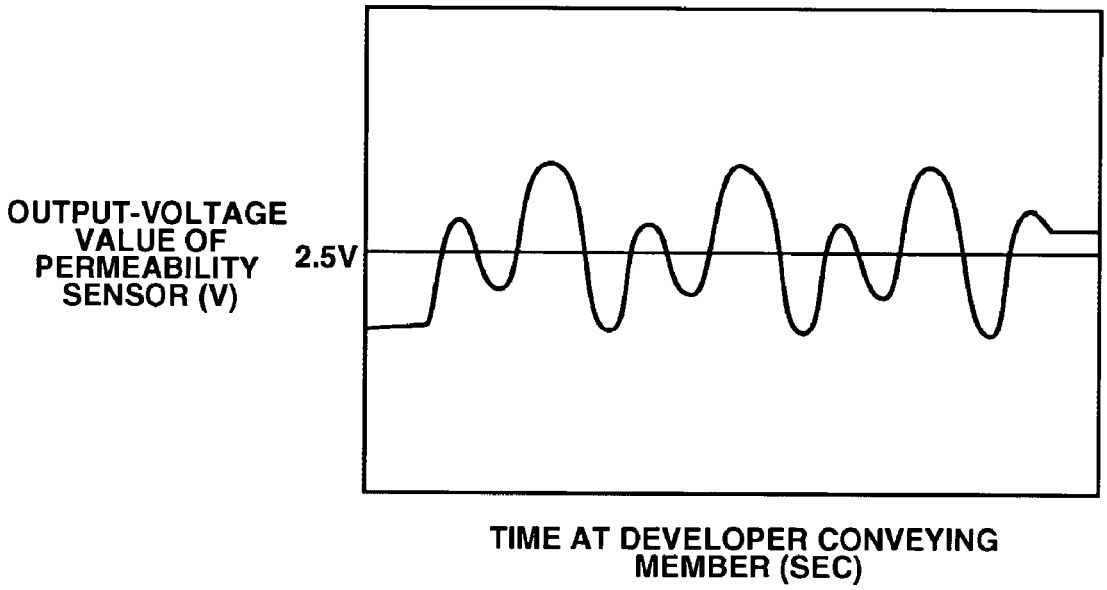
FIG. 3 is a graph illustrating an example of a waveform of an output-voltage value of a permeability sensor.

FIG. 3 illustrates the waveform of an output voltage value of the permeability sensor 45. The waveform of an output voltage value of the permeability sensor 45 has a profile as shown in FIG. 3 with a rotation period of the second screw 44 conveying the developer by rotating. That is, when the fin of the second screw 44 is closest to the measuring surface of the permeability sensor 45, the bulk density of the developer near the measuring surface of the permeability sensor 45 is largest, and, as a result, the output voltage value of the permeability sensor 45 is largest. When the measuring surface of the permeability sensor 45 is placed between fin components of the second screw 44, the bulk density of the developer near the measuring surface of the permeability sensor 45 is smallest, and, as a result, the output voltage value is smallest. When the rib present between fin components of the second screw 44 approaches the measuring surface of the permeability sensor 45, the bulk density of the developer near the measuring surface of the permeability sensor 45 is slightly large, and, as a result, the output voltage value has an intermediate value.

In this embodiment, the value of a control voltage input to the permeability sensor 45 is adjusted so that the mean value of output voltage values of the permeability sensor 45, i.e., the detection value (detection signal) of the permeability sensor 45, during one rotation of the second screw 44 is 2.5 V.

Figure 4:
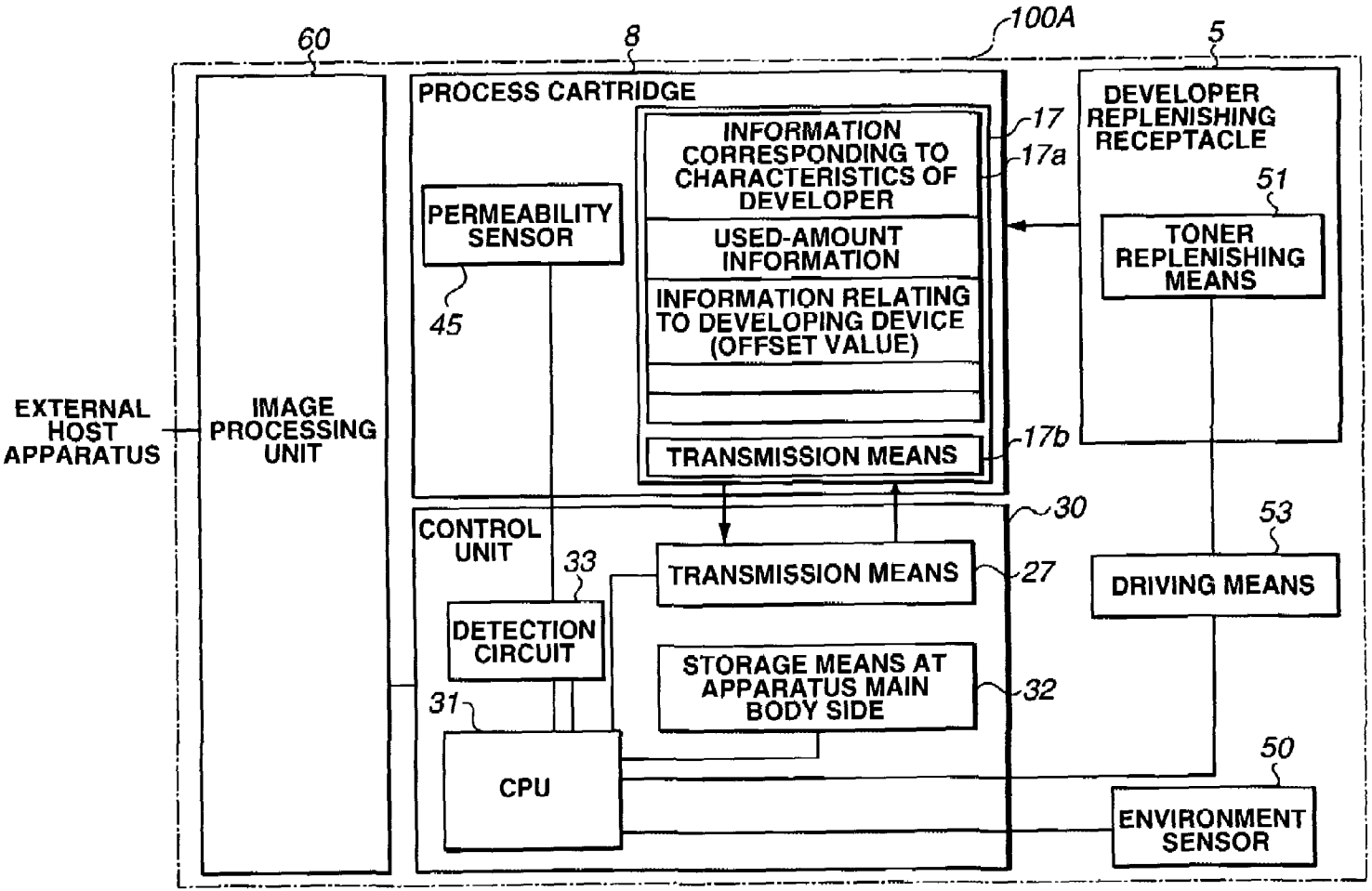
FIG. 4 is a schematic block diagram illustrating control for a toner replenishing operation according to the present invention.

FIG. 4 is a block diagram illustrating control circuitry according to the embodiment. A control voltage is input from a detection circuit 33 to the permeability sensor 45. The output voltage of the permeability sensor 45 is detected by the detection circuit 33 and is then input to a CPU (central processing unit) 31, and is subjected to equalizing processing, and the like.

As described above, since the bulk density of the developer changes when the environment changes, the output value of the permeability sensor 45 corresponding to apparent permeability changes. Accordingly, control is performed so that the mean value of output voltage values, i.e., the detection value, of the permeability sensor 45 is 2.5 V by correcting the control voltage value input to the permeability sensor 45 in accordance with environment, using a control voltage value/environment correction table shown in Table 1.

TABLE 1

Control Voltage Value Environment Correction Table

| Environment | Unit (V) |
|---|---|
| Environment 0 | 0.12 |
| Environment 1 | 0.09 |
| Environment 2 | 0.06 |
| Environment 3 | 0.03 |
| Environment 4 | 0 |
| Environment 5 | −0.03 |
| Environment 6 | −0.06 |
| Environment 7 | −0.09 |
| Environment 8 | −0.12 |

The control voltage value/environment correction table (Table 1) is stored in advance in apparatus-main-body-side storage means 32 provided in the control, unit 30 of the image-forming-apparatus main body 100A. The apparatus-main-body-side storage means 32 may be any one of various memory means, for example, EEPROM or FeRAM as a re-writable and non-volatile memory, or ROM. More specifically, correction values for respective control voltage values are provided for eight different environment conditions, such that environment information for environment 4 (designated as not needing correction in the control voltage value/environment correction table) corresponds to an absolute water content of 10–12.

In this embodiment, when the environment condition is environment 4 in the control voltage value/environment correction table, if a control voltage of 8.0 V is input to the permeability sensor 45, an output value of the permeability sensor 45 of 2.5 V is output.

The CPU 31 of the control unit 30 selects a correction value for the control voltage from the control voltage value/environment correction table in accordance with information from an environment sensor (measuring temperature, humidity and the like), serving as environment detection means, provided in the image-forming-apparatus main body 100A. A corrected control voltage value is obtained using this correction value, for example, by adding a correction value corresponding to each environment to the control voltage value of the permeability sensor 45 in environment 4, and is inputting the corrected control voltage value into the permeability sensor 45.

In detail, for example, the control voltage value is corrected, as a standard reference of the environment 4, by using the voltage value corresponding to each reference varied as the reference Environment 5→, the reference Environment 6→, the reference Environment 7→, and the reference Environment 8 for an environment with high temperature and high humidity. On the other hand, the control voltage value is corrected by using the voltage value corresponding to each reference varied as the reference Environment 3→, the reference Environment 2→, the reference Environment 1→, and the reference Environment 0 for an environment with low temperature and low humidity.

As described above, after the developing operation, the developer is conveyed to the permeability sensor 45, where the toner density is detected. An appropriate amount of toner is timely replenished from the developer replenishing receptacle (toner cartridge) 5 to the developing receptacle 40 in accordance with the detected toner density. A drop port 52 of the developer replenishing receptacle 5 is connected to a toner replenishing opening 47 provided at the developing receptacle 40 at a slightly downstream portion from the permeability sensor 45 in the developer conveying direction of the second screw 44.

Toner replenishment is performed in accordance with a request for toner replenishment from the CPU 31 included in the control unit 30 of the image-forming-apparatus main body 100A, operating as toner-replenishment control means. That is, the CPU 31 of the control unit 30 obtains an amount of driving (the number of revolutions) of a replenishing screw 51, serving as toner replenishing means, provided in the developer replenishing receptacle 5 that is necessary for maintaining the toner density in the developer to a constant value, in accordance with the difference between the detection value of the permeability sensor 45 and a reference output value that has been determined in advance in the apparatus-main-body-side storage means 32. The toner is replenished from the developer replenishing receptacle 5 to the developing receptacle 40 via the drop port 52 and the toner replenishing opening 47 by driving the replenishing screw 51 by driving means 53 in accordance with the obtained amount of driving.

The toner replenished within the developing receptacle 40 is conveyed and mixed with the carrier by the second screw 44, and is further conveyed to a portion near the developing sleeve 41 after being provided with appropriate charges (triboelectrification). The developer is supplied onto the developing sleeve 41 to form a thin film in order to be subjected to developing.

Correction of the Reference Voltage Value

As described above, as the bulk density of the developer changes due to a variation of environment, the detection signal of the permeability sensor corresponding to apparent permeability changes. Furthermore, as the number of printed copies increases, the bulk density of the developer changes, whereby the output value of the permeability sensor changes.

In this embodiment, in addition to correction of the control voltage input to the permeability sensor in accordance with the control voltage value/environment correction table, control for correcting the reference output value of the permeability sensor to be compared with the detection value (detection signal) of the permeability sensor, in accordance with information relating to environment and the number of printed copies.

In order to be able to stably control the toner density of the developer even if the characteristics of the developer, such as charges (triboelectrification) of the toner, the property of provision of charges from the carrier to the toner, and the like, greatly change due to variations in the manufacturing conditions, and the like, this embodiment has a configuration in which the developing-device-side storage means 17*a*, serving as first storage means for storing information relating to the developing device 4, is provided in the developing device 4 provided in the process cartridge 8 detachably mountable in the image-forming-apparatus main body 100A. In this embodiment, at least two correction tables are stored in advance in the apparatus-main-body-side storage means 32, serving as second storage means mounted in the image-forming-apparatus main body 100A, as a plurality of sets of correction information for correcting the reference output value of the permeability sensor 45, and the CPU 31 operating as toner-replenishment control means, selects one of the correction tables stored in the apparatus-main-body-side storage means 32, based on stored contents of the developing-device-side storage means 17*a*.

This configuration will be described in more detail with reference to FIG. 2 and FIG. 4. The developing-device-side storage means 17*a* is provided in the developing device 4. In this embodiment, the developing-device-side storage means 17*a* constitutes a storage device 17 (a memory as a storage medium) together with developing-device-side transmission means 17*b* for controlling read/write of information with respect to the storage means 17*a*. When mounting the developing device 4 in the image-forming-apparatus main body 100A, i.e., in this embodiment, when mounting the process cartridge 8 in the image-forming-apparatus main body 100A, the developing-device-side transmission means 17*b* and image-forming-apparatus-main-body-side transmission means (reading means) 27 for controlling read/write of information with respect to the developing-device-side storage means 17*a* provided in the image-forming-apparatus main body 100A are disposed so as to face each other, to provide a communicable state.

An ordinary semiconductor electronic memory may be used without limitation as the developing-device-side storage means 17*a*. For example, it may be, as an electric memory, applicable of EEPROM or FeRAM as a non-volatile memory. Particularly, in the case of a non-contact memory performing data communication between a memory and a read/write IC (integrated circuit) using an electromagnetic wave, the developing-device-side transmission means 17*b* and the apparatus-main-body-side transmission means 27 may be in a non-contact state. Accordingly, there is no possibility of a failure of contact depending on the mounting state of the developing device 4, and therefore very reliable control can be performed. When performing communication in a non-contact state using an electromagnetic wave, each of the transmission means 17*b* and 27 comprises a communication member for communicating information, such as an antenna, or the like. When performing communication in a contact state, a connector for electrically connecting these means, or the like is used.

As shown in FIG. 4, the developing-device-side storage means 17*a* has a plurality of storage regions for storing information. The developing-device-side storage means 17*a* includes a storage region for storing information corresponding to the characteristics of the toner material. More specifically, as will be described later, a storage region where information relating to the amount of use of the process cartridge 8 (for example, the number of printed copies, the time period of image formation, or the like), serving as information relating to the state of durability of the developer, is timely written and stored, is provided. The developer-device-side storage means 17*a* has a storage region for storing information corresponding to the characteristics of the developer at manufacture or shipping (for example, shipping from a factory) of the process cartridge, and a storage region where information relating to the developing device, such as an offset value for offsetting the reference output value of the permeability sensor 45, and the like, is stored.

The information relating to the characteristics of the developer includes arbitrary information that can be utilized for selecting correction information (for use in a correction table) for the reference output value of the toner-density detection means (permeability sensor) 45 for the developer. For example, an ID number of the correction table may be stored.

Correction of the reference output of the toner-density detection means (permeability sensor) 45 for the developer is not limited to correction in accordance with environment and the number of printed copies. Correction may be performed in accordance with one of the above-described factors, or in accordance with another additional factor.

The amount of use of the process cartridge 8, such as the number of printed copies, or the like (information relating to the state of durability of the developer) may also be held in the image-forming-apparatus main body 100A. An approach of storing the information in a unit itself that is detachably mountable in the image-forming-apparatus main body 100A is advantageous, for example, when the process cartridge 8 can be exchanged and used in a plurality of image-forming-apparatus main bodies 100A.

The apparatus-main-body-side transmission means 27 and the developing-device-side transmission means 17*b* constitute information transmission means for reading and writing information within the developing-device-side storage means 17*a*. The developing-device-side storage means 17*a* is assumed to have a capacity sufficient enough to store a plurality of sets of information required for executing the present invention, such as individual-identification information, characteristic values, and the like of the developing device 4.

In this embodiment, the CPU 31, serving as a central control device of the control unit 30 for sequentially operating the image forming apparatus 100 in accordance with data, programs, and the like stored in the apparatus-main-body-side storage means 32 also operates as means for obtaining the detection value by processing the output voltage value of the permeability sensor 45, means for correcting the control voltage value for the permeability sensor 45, correction-information selection means for selecting one of correction tables stored in the apparatus-main-body-side storage means 32 based on the stored contents of the developing-device-side storage means 17*a*, correction means for correcting the reference output based on the selected correction table, toner-replenishment control means for controlling the amount of toner replenishment by controlling the replenishing screw 51, serving as toner replenishing means, of the developer replenishing receptacle 5, and the used-amount detection means for detecting (counting) the amount of use by the developing device 4, for example, the number of printed copies. An image processing unit 60 is connected to the control unit 30. The image processing unit 60 receives an image signal from an external host apparatus, such as a personal computer, an original-reading apparatus, or the like, connected to the image-forming-apparatus main body 100A so as to be able to perform communication, and transmits a signal relating to image formation to the control unit 30. The control unit 30 controls the operation of each unit of the image forming apparatus 100 in accordance with such an image formation signal.

The present invention will now be described in more detail illustrating some examples.

EXAMPLE 1

Table 2 is a correction table for correcting the reference output value of the permeability sensor 45. The correction table has a set of parameters corresponding to environment, and the number of printed copies. The abscissa represents the number of printed copies. In this table, the number or recording sheets of an arbitrary size used for image formation is converted into the number of sheets of a letter size. The ordinate represents an environment condition. In this table, ID numbers corresponding to four environment conditions are set.

TABLE 2

| | Unit (V) | | | | | |
|---|---|---|---|---|---|---|
| Environment | 0 | 10,000 | 20,000 | 30,000 | 40,000 | 50,000 |
| | | | Table ID 0 | | | |
| Environment 1 | 0 | 0 | 0.08 | 0.16 | 0.24 | 0.32 |
| Environment 2 | 0 | 0 | 0.05 | 0.1 | 0.17 | 0.24 |
| Environment 3 | 0 | 0 | 0.03 | 0.05 | 0.1 | 0.16 |
| Environment 4 | 0 | 0 | 0 | 0 | 0.04 | 0.08 |
| | | | Table ID 1 | | | |
| Environment 1 | 0 | 0 | 0 | 0.04 | 0.08 | 0.16 |
| Environment 2 | 0 | 0 | 0 | 0.02 | 0.06 | 0.12 |
| Environment 3 | 0 | 0 | 0 | 0.01 | 0.04 | 0.08 |
| Environment 4 | 0 | 0 | 0 | 0 | 0.02 | 0.04 |
| | | | Table ID 2 | | | |
| Environment 1 | 0.08 | 0.16 | 0.24 | 0.32 | 0.4 | 0.48 |
| Environment 2 | 0.06 | 0.1 | 0.16 | 0.24 | 0.32 | 0.4 |
| Environment 3 | 0.03 | 0.05 | 0.08 | 0.16 | 0.24 | 0.32 |
| Environment 4 | 0 | 0 | 0 | 0.08 | 0.16 | 0.24 |
| | | | Table ID 3 | | | |
| Environment 1 | 0 | 0 | 0 | 0 | 0.04 | 0.08 |
| Environment 2 | 0 | 0 | 0 | 0 | 0.04 | 0.08 |
| Environment 3 | 0 | 0 | 0 | 0 | 0.04 | 0.08 |
| Environment 4 | 0 | 0 | 0 | 0 | 0.04 | 0.08 |
| | | | Table ID 4 | | | |
| Environment 1 | 0 | −0.04 | 0 | 0.04 | 0.08 | 0.12 |
| Environment 2 | 0 | −0.01 | −0.01 | 0.02 | 0.06 | 0.1 |

TABLE 2-continued

| | Unit (V) | | | | | |
|---|---|---|---|---|---|---|
| Environment | 0 | 10,000 | 20,000 | 30,000 | 40,000 | 50,000 |
| Environment 3 | 0 | −0.03 | −0.02 | 0.01 | 0.05 | 0.09 |
| Environment 4 | 0 | −0.08 | −0.04 | 0 | 0.04 | 0.08 |

In Example 1, five parameter sets shown in Table 1 are stored in the apparatus-main-body-side storage means 32 provided in the storage unit 30 of the image-forming-apparatus main body 100A as correction tables for correcting reference output values for the permeability sensor 45. These five parameter sets are set in advance in accordance with the characteristics of each specific developer, or the characteristics of a developer within a predetermined range.

More specifically, in Example 1, five parameter sets in which correction values for the reference output value of the permeability sensor 45 are set for the numbers of printed copies of 0, 10,000, 20,000, 30,000, 40,000, and 50,000, and for four different environment conditions, for example, such that environment information for environment 3 corresponds to an absolute water content of 8–12, in accordance with the characteristics of the developer, charges (triboelectrification) of the toner in Example 1.

In detail, for example, the table ID 0 is a case where the electrical charge of the toner is standard (a standard value of the electrical charge), the table ID 1 is a case where the electrical charge of the toner is low. The table ID 2 is a case where the electrical charge of the toner is high, and the table ID 3 is a case where the endurance change of the electrical charge of the toner is small, and the table ID 4 is a case where the endurance change of the electrical charge of the toner is large.

Figure 5:
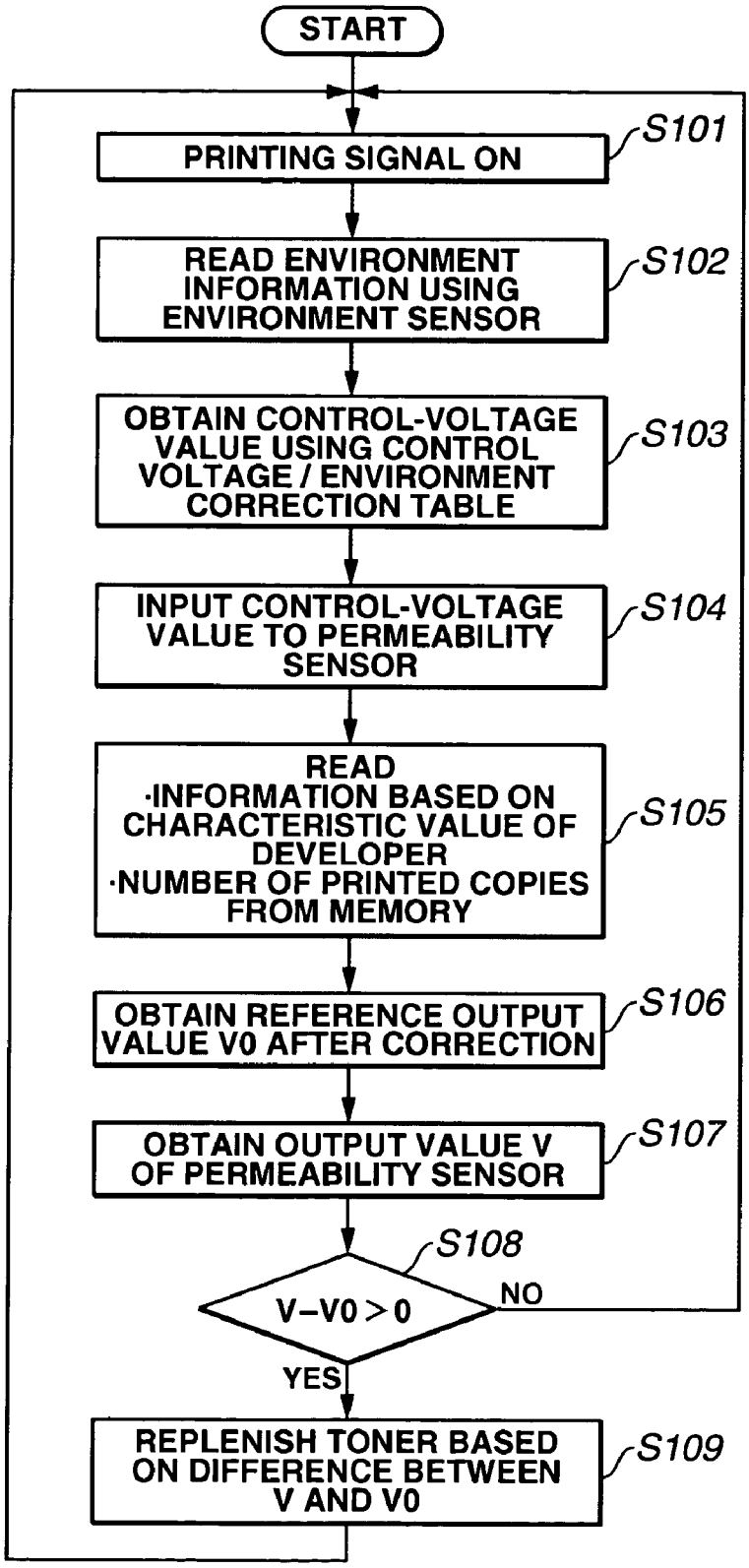
FIG. 5 is a flowchart illustrating a toner replenishing operation according to the present invention.

FIG. 5 is a flowchart illustrating a toner replenishing operation in Example 1. When a printing signal is turned on (step S101), the CPU 31 of the control unit 30 of the image-forming-apparatus main body 100A reads information relating to environment from an environment sensor 50 provided in the image-forming-apparatus main body 100A (step S102). Then, the CPU 31 obtains the control voltage value after correction to be input to the permeability sensor 45 from the control voltage/environment correction table shown in Table 1 stored in the apparatus-main-body-side storage means 32 provided in the control unit 30 of the image-forming-apparatus main body 100A (step S103). Then, the CPU 31 inputs the control voltage value after correction to the permeability sensor 45 (step S104).

Then, the CPU 31 reads information relating to the characteristic value of the developer, i.e., the number of printed copies (used-amount information), from the developing-device-side storage means 17*a* provided in the developing device 4, via the apparatus-main-body-side transmission means 27 and the developing-device-side transmission means 17*b* (step S105). In Example 1, information for selecting a correction table stored in the apparatus-main-body-side storage means 32, for example, information for assigning an ID of the correction table, is stored in the developing-device-side storage means 17*a* as information based on the characteristic value of the developer.

As described above, IDs stored in the developing-device-side storage means 17*a* are IDs corresponding to characteristics of respective developers. For example, since charging characteristics (triboelectrification) of toners differ depending on the color of a toner, different IDs are stored in accordance with toners of respective colors. In addition, when charging characteristics of a toner have changed due to a deviation in manufacturing conditions, or when the toner has been improved, IDs are stored in accordance with charging characteristics of respective toners.

The CPU 31 selects an appropriate parameter set based on read information relating to the characteristic value of the developer, from the correction table for correcting the reference output value of the permeability sensor 45 shown in Table 2, and obtains the reference output value V0 after correction using a correction value selected based on environment information from the environment sensor 50 and the read number of printed copies, i.e., by adding the correction value to the reference output value previously set in the apparatus-main-body-side storage means 32 (step S106). The CPU 31 also obtains the mean value of output voltage values, i.e., the detection value (detection signal), V of the permeability sensor 45 (step S107).

The CPU 31 compares the detection value V of the permeability sensor 45 with the reference output value V0 after correction (step S108). When $V-V0 \leqq 0$, toner replenishment is not performed, and it is awaited until a printing signal is input. When $V-V0>0$, the toner is replenished in the above-described manner based on the difference between the V and V0 (step S109), and thereafter it is awaited until a printing signal is input.

EXAMPLE 2

By storing an offset value for offsetting the reference output voltage of the permeability sensor 45 in the developing-device-side storage means 17*a*, it is possible to enlarge a range of correction of the reference output value of the permeability sensor 45 without increasing the capacity of the apparatus-main-body-side storage means 32 provided in the control unit 30 of the image-forming-apparatus main body 100A.

The offset value is a value corresponding to charging characteristics (triboelectrification) of the toner of the developer, and allows expansion of a range of correction for the reference output value by combination with correction using the above-described correction table.

For example, when providing an improved version of the image forming apparatus, there is the possibility that a developer having characteristics different from the characteristics of the previously used developer is supplied to the developing device. In such a case, a case in which it is difficult to correct the reference output value only by using the above-described correction table may occur. Accordingly, an offset value corresponding to the characteristics of each developer is stored in the developing-device-side storage means 17*a*.

More specifically, correction control with a wider range can be performed, for example, by providing an offset value of 0.05 V and combining the offset value with a correction value obtained from the correction table. The offset value may be appropriately changed depending on the characteristics of the developer. For example, in one an approach, an offset value is set and stored for a toner of each color, and correction control is performed in accordance with the charging characteristics of a toner of each color. In another approach, offset values are appropriately set and stored, for example, when the charging characteristics of a toner change due to a variation in manufacturing conditions, or due to improvement of a toner, and correction control is performed using the stored offset value.

Figure 6:
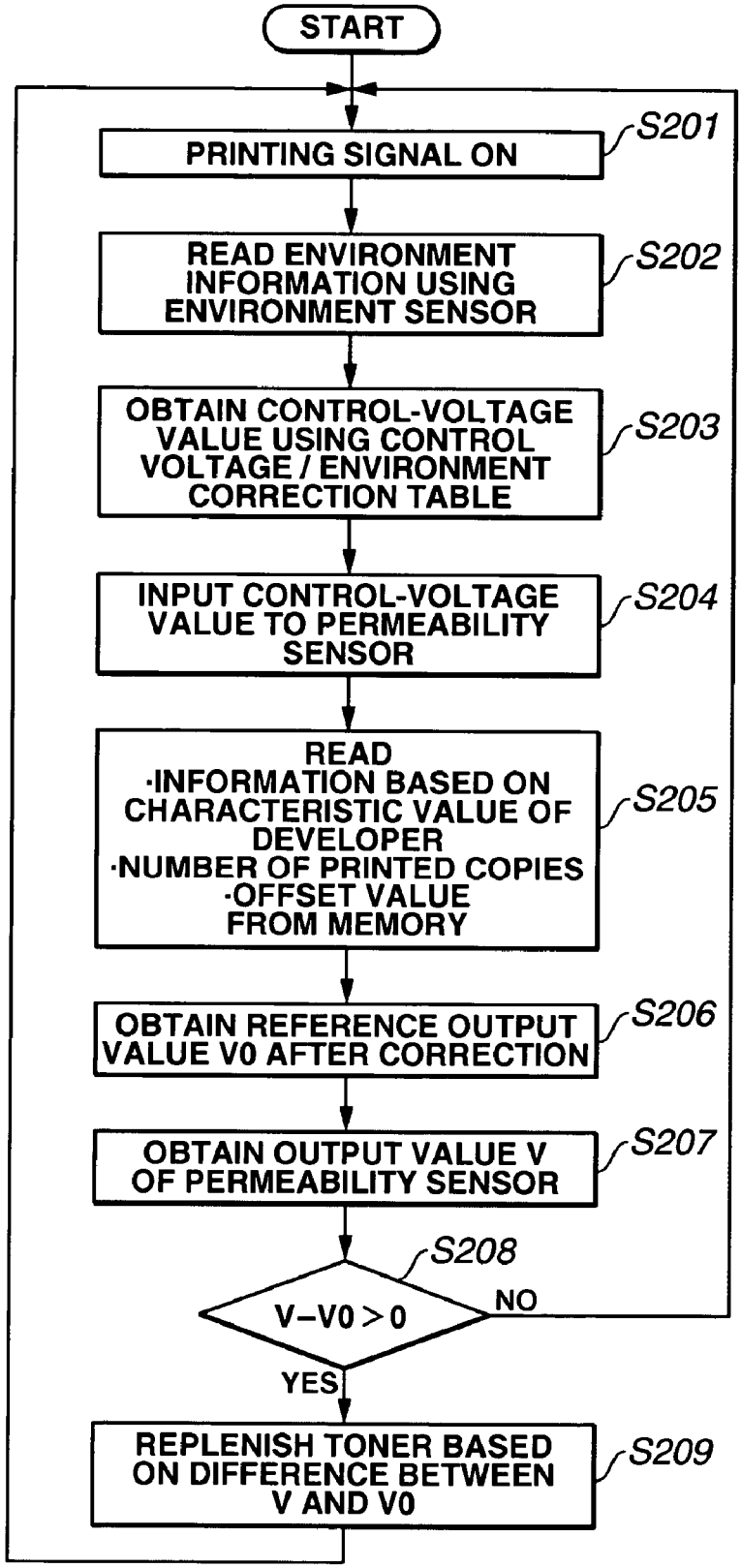
FIG. 6 is a flowchart illustrating another toner replenishing operation according to the present invention.

FIG. 6 is a flowchart illustrating a toner replenishing operation in Example 2. When a printing signal is turned on (step S201), the CPU 31 of the control unit 30 of the image-forming-apparatus main body 100A reads information relating to environment from the environment sensor 50 provided in the image-forming-apparatus main body 100A (step S202). Then, the CPU 31 obtains the control voltage value after correction to be input to the permeability sensor 45 from the control voltage/environment correction table shown in Table 1 stored in the apparatus-main-body-side storage means 32 provided in the control unit 30 of the image-forming-apparatus main body 100A (step S203). Then, the CPU 31 inputs the control voltage value after correction to the permeability sensor 45 (step S204).

Then, the CPU 31 reads information relating to the characteristic value of the developer, i.e., the number of printed copies, and the offset value, from the developing-device-side storage means 17*a* provided in the developing device 4, via the apparatus-main-body-side transmission means 27 and the developing-device-side transmission means 17*b* (step S205). In Example 2, information for selecting a correction table stored in the apparatus-main-body-side storage means 32, for example, information for assigning an ID in the correction table, is stored in the developing-device-side storage means 17*a* as information based on the characteristic value of the developer.

The CPU 31 selects an appropriate parameter set based on read information relating to the characteristic value of the developer, from the correction table for correcting the reference output value of the permeability sensor 45 shown in Table 2, and obtains the reference output value V0 after correction using a correction value selected based on environment information from the environment sensor 50 and the read number of printed copies, i.e., by adding the correction value and the offset value to the reference output value previously set in the apparatus-main-body-side storage means 32 (step S206). The CPU 31 also obtains the mean value, i.e., the detection value (detection signal), V of output voltage values of the permeability sensor 45 (step S207).

The CPU 31 compares the output value V of the permeability sensor 45 with the reference output value V0 after correction (step S208). When $V-V0 \leqq 0$, toner replenishment is not performed, and it is awaited until a printing signal is input. When $V-V0>0$, the toner is replenished in the above-described manner based on the difference between the V and V0 (step S209), and thereafter it is awaited until a printing signal is input.

As described above, according to the foregoing examples, by allowing selection of a correction table for correcting the reference output value in accordance with the characteristics of the developer, it is possible to stably control the toner density of the developer even if the characteristics of the developer largely change.

Although in the above-described embodiments, the image forming apparatus 100 does not have a dedicated cleaning device for removing/collecting adhering matter from the photosensitive drum 1 as cleaning means for the photosensitive drum, the present invention is not limited to such a configuration. For example, a cleaning device including a blade or the like that has been conventionally used may be provided.

Although in the above-described embodiments, the toner is replenished from the developer replenishing receptacle 5 to the developing receptacle 40, the present invention is not limited to such an approach. The present invention may also be applied to a case in which a two-component developer obtained by mixing mainly a toner and a carrier is replenished.

In the above-described embodiments, the toner-density detection means for the toner is a permeability sensor. As described above, the permeability sensor is preferable because it has features of a small size, and the like. However, the present invention is not limited to the permeability sensor. The present invention may also be applied to any other appropriate toner-density detection means for replenishing a toner in accordance with the difference between the output value of the toner-density detection means and a predetermined reference output value, for example, a sensor in which the reference output value is corrected in accordance with environment, the number of printed copies, or the like may also be used.

Although in the above-described examples, five correction tables are set, the present invention is not limited to such an approach. For example, at least five necessary correction tables may be set in accordance with the characteristics of the developer.

As described above, according to the foregoing embodiments, it is possible to provide an image forming apparatus, a cartridge and a storage medium that can control a toner density in a developer in accordance with the characteristics of the developer.

By storing information corresponding to the characteristics of a developer in developing-device-side storage means, and selecting a correction table for correcting a reference output value of a permeability sensor, it is possible to stably control the toner density of the developer, and as a result, prevent the problems of fog, toner dispersion, and a decrease of the density, even if the characteristics of the developer largely change.

By storing a plurality of correction tables for correcting a reference output value of a permeability sensor provided in a developing device, in an apparatus-main-body-side storage means, it is possible to more assuredly stabilize control of the toner density of a developer in accordance with the characteristics of the developer without increasing the capacity of developing-device-side storage means.

By storing an offset value for offsetting a reference output value of a permeability sensor in developing-device-side storage means, it is possible to more assuredly stabilize control of the toner density of a developer in accordance with the characteristics of the developer, without increasing the capacity of apparatus-main-body-side storage means.

The individual components shown in outline or designated by blocks in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a developing device comprising a developing receptacle configured to accommodate a developer including a toner and a carrier, and a detector configured to detect a value corresponding to a toner density of the developer within said developing receptacle;

a replenishing member configured to perform a replenishing operation that replenishes the toner to the developing receptacle in accordance with the value detected by the detector;

a controller configured to control the replenishing operation preformed by the replenishing member based on the value detected by the detector and a reference value; and a first storage unit having a storage region configured to store information for setting the reference value according to characteristics of the developer, wherein the controller is configured to set the reference value based on the information for setting the reference value according to characteristics of the developer.

2. An image forming apparatus according to claim 1, wherein said controller is configured to set the reference value based on the information for setting the reference value according to characteristics of the developer and correction information according to the information for setting the reference value according to characteristics of the developer.

3. An image forming apparatus according to claim 2, wherein the correction information is a correction table for correlating an environment or an amount of use of said developing device with an amount of correction for the reference value.

4. An image fanning apparatus according to claim 2, further comprising an environment detection sensor for detecting an environment within said image forming apparatus, wherein said controller sets the reference value using information relating to the environment from said environment detection sensor, information relating to an amount of use of said developing device, and the information for setting the reference value according to characteristics of the developer.

5. An image forming apparatus according to claim 4, wherein said first storage unit further includes a storage region configured to store the information relating to the amount of use of said developing device.

6. An image forming apparatus according to claim 2, further comprising a second storage unit having a storage region storing the correction information, wherein said controller selects the correction information stored in said second storage unit based on the information for setting the reference value according to characteristics of the developer stored in said first storage unit, and sets the reference value based on the selected correction information.

7. An image forming apparatus according to claim 1, wherein said developing device is detachably mountable in a main body of said image forming apparatus, and wherein said first storage unit is provided in said developing device.

8. An image forming apparatus according to claim 1, wherein a cartridge comprising at least said developing device and an image bearing member is detachably mountable in said image forming apparatus, and wherein said first storage unit is provided in said cartridge.

9. An image forming apparatus according to claim 1, wherein said first storage unit further includes a storage region storing an offset value for the reference value, and wherein said controller sets the reference value based on the offset value and the information for setting the reference value according to characteristics of the developer.

10. An image forming apparatus according to claim 1, wherein said detector is a permeability sensor configured to output a signal corresponding to permeability of the developer.

11. A developing device detachably mountable in an image forming apparatus, comprising:

a developing receptacle configured to accommodate a developer including a toner and a carrier;

a detector configured to detect a value corresponding to a toner density of the developer within said developing receptacle, wherein the toner is replenished in the developing receptacle based on the value detected by the detector and a reference value; and a storage medium configured to store information relating to said developing device, wherein said storage medium includes a first storage region configured to store information for setting the reference value according to characteristics of the developer.

12. A developing device according to claim 11, wherein said storage medium further includes a second storage region configured to store information relating to an amount of use of said developing device.

13. A developing device according to claim 11, wherein the information for setting the reference value according to the characteristics or the developer is information for selecting correction information for correcting the reference value stored in a storage portion provided in said image forming apparatus.

14. A developing device according to claim 11, wherein said storage medium further includes a third storage region for storing an offset value for the reference value.

15. A developing device according to claim 11, wherein said storage medium further includes a communication portion for communicating with said image forming apparatus.

16. A storage medium to be mounted in a developing device detachably mountable in an image forming apparatus, the developing device comprising a developing receptacle configured to accommodate a developer including a toner and a carrier, and a detector configured to detect a value corresponding to a toner density of the developer within the developing receptacle, where the toner is replenished in the developing receptacle based on the value detected by the detector and a reference value, said storage medium comprising:

a first storage region configured to store information for setting the reference value according to characteristics of the developer.

17. A storage medium according to claim 16, further comprising a second storage region for storing information relating to an amount of use of the developing device.

18. A storage medium according to claim 16, wherein the information for setting the reference value according to the characteristics of the developer is information for selecting correction information for correcting the reference value stored in a storage portion provided in the image forming apparatus.

19. A storage medium according to claim 16, further comprising a third storage region for storing an offset value for the reference value of the detector.

20. A storage medium according to claim 16, further comprising a communication portion for communicating with the image forming apparatus.

* * * * *